US005471819A

United States Patent [19]

Weckerle

[11] Patent Number: 5,471,819

[45] Date of Patent: Dec. 5, 1995

[54] METHOD AND DEVICE FOR FILLING TUBES

[76] Inventor: Peter Weckerle, Petersbrunner Str. 8, D-82319 Starnberg, Germany

[21] Appl. No.: 187,105

[22] Filed: Jan. 24, 1994

[30] Foreign Application Priority Data

Jan. 26, 1993 [DE] Germany ..... 43 02 014.3

[51] Int. Cl.[6] ..... B65B 3/00; B65B 5/08

[52] U.S. Cl. ..... 53/444; 53/446; 53/467; 53/468; 53/539; 53/544; 53/284.5

[58] Field of Search ..... 53/467, 468, 473, 53/492, 446, 444, 443, 448, 539, 543, 64, 544, 284.5, 247, 381.1, 373.7, 479

[56] References Cited

U.S. PATENT DOCUMENTS

| | | | |
|---|---|---|---|
| 3,524,295 | 8/1970 | Spaulding | 53/448 X |
| 3,803,795 | 4/1974 | Ouellette | 53/492 |
| 3,889,442 | 6/1975 | Grahn et al. | 53/492 |
| 4,048,780 | 9/1977 | Chenevard | 53/473 X |
| 4,191,003 | 3/1980 | Talarico | 53/539 X |
| 4,231,213 | 11/1980 | Okazaki | 53/539 X |
| 4,642,967 | 2/1987 | Culpepper | 53/398 |
| 4,686,813 | 8/1987 | Sawada | 53/473 |
| 5,069,594 | 12/1991 | Bott et al. | 53/492 X |

FOREIGN PATENT DOCUMENTS

| | | |
|---|---|---|
| 1890164 U | of 1963 | Germany . |
| 3529657 | 2/1987 | Germany . |
| 1593203 | 7/1981 | United Kingdom . |

*Primary Examiner*—Horace M. Culver
*Attorney, Agent, or Firm*—Smith-Hill and Bedell

[57] ABSTRACT

Empty tubes are received in a pallet with the tubes oriented with their central axes substantially perpendicular to a conveyor plane and at a predetermined spacing along first and second axes that are perpendicular to each other and parallel to the conveyor plane. All the empty tubes are simultaneously removed from the pallet, and the tubes are moved mutually apart along the first axis and are subsequently moved mutually apart along the second axis, and the tubes are then filled and sealed. The tubes are moved mutually together to a spacing that is substantially the same as the predetermined spacing and the filled tubes are placed in a pallet.

21 Claims, 1 Drawing Sheet

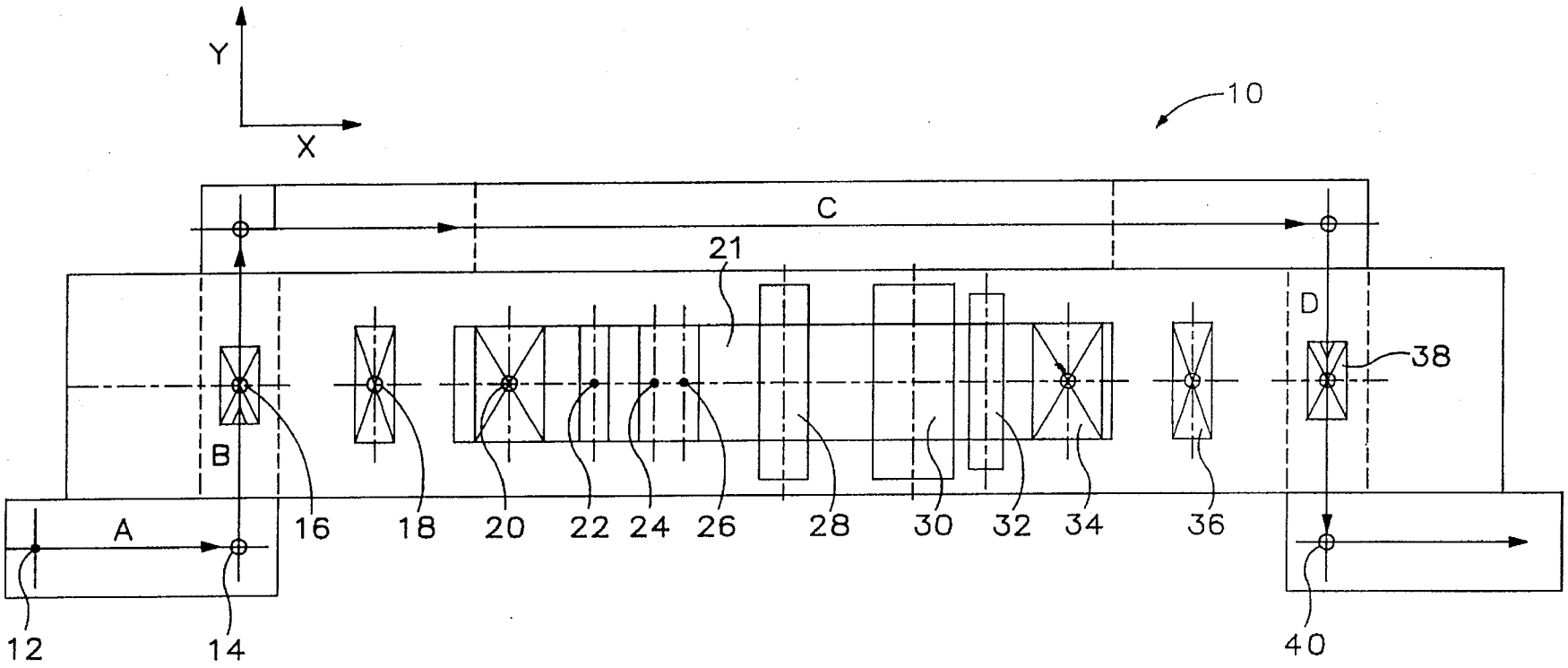
10
38
D
40
36
34
32
30
C
28
21
26
24
22
20
18
16
X
Y
B
14
A
12

METHOD AND DEVICE FOR FILLING TUBES

The present invention involves a procedure and a device for filling tubes arranged on pallets.

There are existing devices for filling tubes, in which pairs of tubes from a magazine are clamped, filled, sealed and finally placed on a conveyor belt for packaging. These tubes already have a screw top, are open at the bottom end and are usually handled top down. This type of device requires very rapid processing to obtain sufficient throughput. Feasible throughput rates are in the neighborhood of 150 tubes per minute. Shorter processing cycles are difficult to achieve at reasonable (power) outputs because rapid acceleration is needed while handling the tubes and because the time required for each individual procedure is minimal, e.g. welding the open ends of the tubes. Another disadvantage of the existing procedure is that the containers in which the open, empty tubes are delivered have to be disposed of, which, from the standpoint of environmental concerns, is not desirable.

Therefore, the purpose of the invention is to create a procedure and a device that achieves high throughput and for which there is less waste than with existing devices and which uses substantially less power.

According to the invention, the same pallets are used to deliver the open, empty tubes on which the filled tubes will ultimately be offered for sale. However, the tubes on these display pallets are very close together because packing the tubes very densely on the pallets is desirable because of space limitations at the point of sale. Thus, at the very beginning of the procedure, the tubes are in an extraction or feeder device—arranged at the very least in series, but preferably two dimensionally, i.e. all the tubes in the pallet are simultaneously gripped and moved apart in an initial direction, i.e. the spacing between the tubes is increased. Once all the tubes in the pallet are simultaneously gripped, they are moved apart in a second direction (after being moved apart in the first direction). In the preferred form of the invention, the tubes are set down between opening out operations and then gripped again. This means that the use of operating machinery can be kept to a minimum. In the preferred form of the invention, the tubes are gripped in an initial operation, moved apart in the initial direction and then set down. In a second operation, the empty tubes that were set down are gripped again, moved apart in the second direction and transferred into the holding devices of a hoisting apparatus, which passes the tubes through the various stations of the filling device.

In the preferred form of the invention, the tubes are aligned according to their position of rotation, after being transferred into the holding devices. This is important for the sealing operation which follows the filling operation. During sealing, the cylindrical tube is pressed together near the rear fill opening and sealed, crimped or bonded. The tube thus assumes its typical tube shape. However, it is desirable that the label be on the flattened part of the tube after it has been pressed, rather than near the heavily crimped corners of the welding.

In a very reliable and simply-engineered form of the invention, the tubes are held in holding devices in which the tubes are held in their position by a friction clutch so that they cannot rotate. The grip of the holding device is loosened when it is raised by means of a piston and the tube rotated into the desired position. In the preferred form of the invention, the tube is thus aligned by an optical detector, into whose range the tube is raised at the same time the holding device is uncoupled. The detector reads a marking applied to the tube and can turn the tube in a specified direction based on this marking.

Before being filled, the tubes are cleaned out in series using sterilizing or inert gas. This removes any pollutants which could interfere with the quality of the product to be put in the tubes. At the same time, this prevents any subsequent oxidation of the product from residual oxygen present in the tube.

The tubes are filled simultaneously in series in the filling device. During filling, a fill nozzle is inserted into the rear, cylindrical end of the tube up to its front end. The diameter of the fill nozzle is only slightly smaller than that of the tube itself. The product to be filled is ejected at a rate somewhat greater than the rate at which the fill nozzle is raised. This ensures that the tube will be filled essentially without any air bubbles. The number of tubes filled in a series is between 5 and 20, but preferably between 10 and 15.

After being filled, the tubes are bonded or welded at the back end. In the preferred form of the invention, the spacing between tubes in a row is therefore wide enough so that the tubes in a row can be sealed simultaneously by two pressure or heat clamps without the flattened weld points coming into contact. Ideally, therefore the spacing should be somewhat greater than half the tube circumference. In this respect the procedure according to invention is positively remarkable, in that the larger number of tubes simultaneously welded means that the number of cycles is reduced and the welding time can be increased in comparison to existing procedures. This in turn means better weld quality and results in a lower rate of discard. After being welded or bonded, the tubes can be given an identification code to identify the batch, the processing date, etc. in the area that has been flattened. The code can be either pressed or stamped on the end of the tube.

After being welded, all the tubes are rotated to an angle that is offset from the directions of the rows and columns and their diagonals on the display pallet (usually 0°, 45°, or 90°). The tubes are moved back together again on the display pallet without disturbing the flattened, welded tube ends of adjacent tubes. In the preferred form of the invention, the tubes are rotated at an angle of 20° to 60° to each other.

After being sealed, the rotated tubes are again gripped by a gripping device and moved back together in one direction. They are then set down, picked up again and moved back together in the second direction.

The tubes are moved together to the same degree as they were moved apart out at the beginning of the procedure. This is because the filled tubes will be put back on the same pallets on which they were delivered. These are the display pallets on which the goods are offered for sale to the end user in a supermarket or retail store. These display pallets are transported ( e.g. on a conveyor belt) at the same speed from the beginning of the fill device to its end, so that the tubes can be placed in the same pallet on which they were delivered. This is, environmentally speaking, extremely advantageous since the use of special packaging for shipping the unfilled tubes is unnecessary. The invention thus makes a contribution to waste reduction.

Because the number of tubes that can be processed simultaneously is greater than with existing procedures, the cycle time can be reduced and the length of the processing times thus increased. This, in turn, makes possible the use of drive mechanisms with less power, so that the power requirement per tube fill can be reduced, despite an increase in throughput of 150 tubes per minute for existing facilities as compared to 500 tubes per minute. This high throughput rate predetermines the use of machinery in the areas of commodities and food, e.g. for toothpaste, mustard, catsup, etc.

Examples of the invention are described below by way of the schematic drawing, the single FIGURE of which shows a plan view of a tube filling device. The tube filling device 10 consists of a conveyer system designated with A, B, C, and D for the tube display pallets and a conveyor system for the tubes removed from the pallets and transferred into the holding devices and passed through the various work stations of the filling device 10.

A display pallet containing empty tubes and outer packaging is fed to the feed station 12 of the tube filling device 10. Via conveyor belt A, the display pallet with outer packaging is conveyed to the station 14 where the outer packaging is removed from the display pallet, e.g. by an automatic vacuum device. The outer packaging is then transported to the end of the tube filling device (e.g. on a conveyor belt underneath the conveyor belt for the display pallets), where the outer packaging is again put on the display pallet now mounted with filled tubes. The pallet, which may contain 5 rows of 10 tubes, is then transported via conveyor belt B into the removal station 16, where all 50 tubes on the display pallet are simultaneously removed by a gripping device (not shown). In station 18 these tubes are first moved apart in y direction and set down. Then they are picked up again and moved apart in x direction in station 20 and inserted in the holding devices of a conveyor system 21 for transport through the tube filling device. The change in spacing of the tubes when moving apart is schematically represented by the rectangle in stations 16, 18 and 20.

From station 20 on, further processing of the tubes in the holding devices is always done in rows and simultaneously. In station 22 the tubes are raised into the holding devices and held even with optical sensors. This uncouples the holding devices, held in their position by a friction clutch so they cannot rotate, so that the tubes can be freely rotated. After the marking made on the tube has been detected, the tubes are again engaged, so that they all have the same alignment.

In station 24 the tubes are cleaned and treated with gas to remove dirt and/or oxygen from the empty tubes. In station 26 the tubes are then filled, for example under protective gas.

The metering pump for the filling device 26 is indicated with reference number 28. In station 30 the tubes are welded. In this process the tubes (open end up) are welded between heated pressure clamps transverse to the direction of feed. At the same time a marking that indicates batch and/or fill parameters can be stamped into the end of the tube.

Coding can also be done in the next station 32, where the tubes are all turned in the same direction so that the flattened tube ends do not obstruct each other when they are subsequently compressed. At station 34 nothing happens until 5 rows of 10 tubes have come in. Now the number of tubes in station 34 corresponds exactly to the number of tubes on the display pallet. After the required number of tubes is reached, they are gripped simultaneously by a clamping device, moved together in x direction and set down in station 36. There the tubes are again taken up, moved together in y direction and inserted into the display pallet in control station 38, which in the meantime has reached station 38 via conveyor belts C and D. In station 40, the outer packaging, transported beneath conveyor belts B to D, is again placed on the display pallets by an automatic device. From there, the tubes, filled and packaged for sale, can be removed for possible automatic stacking.

I claim:

1. A method for filling tubes, in which the tubes are transported in a feed direction parallel to a conveyor plane from an entry station to an exit station, said method comprising:

(a) receiving empty tubes in a pallet at the entry station, the tubes in the pallet being oriented with their central axes substantially perpendicular to the conveyor plane and being at a predetermined spacing along first and second axes that are perpendicular to each other and parallel to the conveyor plane, (b) simultaneously removing all the empty tubes from the pallet, (c) moving the tubes mutually apart along the first axis, and subsequently moving the tubes mutually apart along the second axis, (d) filling and sealing the tubes, (e) moving the tubes mutually together to a spacing that is substantially the same as said predetermined spacing, and (f) placing the filled tubes in a pallet at the exit station.

2. A method according to claim 1, wherein said first axis is perpendicular to the feed direction.

3. A method according to claim 1, wherein step (e) comprises moving the tubes mutually together along one of said first and second axes and subsequently moving the tubes mutually together along the other of said first and second axes.

4. A method according to claim 1, wherein step (e) comprises moving the tubes mutually together along said second axis and subsequently moving the tubes mutually together along said first axis.

5. A method according to claim 1, wherein step (d) comprises filling the tubes byway of open upper ends of the tubes, and closing the tubes by clamping the upper end of each tube.

6. A method according to claim 5, comprising clamping the upper end of each tube to form a linear seal extending transverse to the feed direction, and rotating each tube so that the linear seal is oriented along a line that is not parallel to the feed direction or perpendicular to the feed direction or at 45 degrees to the feed direction.

7. A method according to claim 6, wherein the first axis is perpendicular to the feed direction and step (c) comprises moving the tubes mutually apart along the first axis so that the central axes are spaced along the first axis at a distance equal to at least half the tube circumference.

8. A method according to claim 1, comprising, concurrently with steps (b)–(e), transporting the pallet from the entry station to the exit station, and step (f) comprises placing the filled tubes in the pallet from which the tubes, when empty, were removed at the entry station.

9. A method according to claim 1, wherein the pallet received at the entry station contains both empty tubes and outer packaging and the method further comprises delivering the pallet and the outer packaging from the entry station to the exit station and step (f) comprises placing the filled tubes in the pallet received from the entry station, and the method further comprises applying the outer packaging to the pallet containing the filled tubes.

10. Apparatus for filling tubes arranged two-dimensionally on pallets at a predetermined spacing along first and second mutually perpendicular axes and having open upper ends, said apparatus comprising:

a conveyor system with holding devices for receiving tubes and transporting the holding devices and tubes contained therein in a feed direction from an entry station to an exit station, a first gripping device for gripping empty tubes in a pallet received at the entry station, removing the tubes from the pallet, moving the tubes mutually apart along said first axis, and setting the tubes down, a second gripping device for gripping the tubes that have been set down by the first gripping device, moving the tubes mutually apart along said second axis, and placing the tubes in respective holding devices of the conveyor system, a filling device for filling the tubes by way of the open upper ends thereof, a sealing device for sealing the upper ends of the tubes, and a pallet loading mechanism for gripping the tubes in the holding devices, removing the tubes from the holding devices, moving the tubes mutually together to a spacing that is substantially the same as the predetermined spacing, and placing the tubes in a pallet at the exit station.

11. Apparatus according to claim 10, wherein pallet loading mechanism comprises a third gripping device for gripping the tubes in the holding devices, removing the tubes from the holding devices, moving the tubes mutually together along one of said first and second axes, and setting them down, and a fourth gripping device for gripping the tubes that have been set down by the third gripping device, moving the tubes mutually together along the other of said first and second axes, and placing the tubes in the pallet.

12. Apparatus according to claim 11, wherein the third gripping device moves the tubes mutually together along the first axis.

13. Apparatus according to claim 10, wherein the first axis is perpendicular to the feed direction.

14. Apparatus according to claim 10, comprising a second conveyor for transporting pallets from the entry station to the exit station.

15. Apparatus according to claim 10, comprising a mechanism for removing outer packaging from the pallet before delivery of the pallet to the entry station and a mechanism for applying outer packaging to the pallet after the filled tubes have been placed in the pallet by the pallet loading mechanism.

16. Apparatus according to claim 10, comprising friction clutches for resisting rotation of the tubes in the holding devices.

17. Apparatus according to claim 16, comprising a sliding clutch for raising the holding devices to a position at which the friction clutch is disengaged.

18. Apparatus according to claim 10, comprising a mechanism for rotating the tubes to a selected angular position.

19. Apparatus according to claim 18, comprising an optical detector for controlling the mechanism for aligning the tubes, and a means for raising the tubes for inspection by the optical detector.

20. Apparatus according to claim 10, wherein the sealing device comprises a pair of pressure clamps extending transverse to the feed direction for sealing the upper ends of the tubes by forming a linear seal.

21. Apparatus according to claim 20, further comprising a means for rotating the tubes into a position in which the linear seal in oriented along a line that is not parallel to the feed direction or perpendicular to the feed direction or at 45 degrees to the feed direction.

* * * * *